United States Patent [19]

Hull et al.

[11] 4,263,063

[45] Apr. 21, 1981

[54] PROCESS FOR STABILIZING DIMENSIONS OF DUPLEX STAINLESS STEELS FOR SERVICE AT ELEVATED TEMPERATURES

[75] Inventors: Frederick C. Hull, Pittsburgh, Pa.; John C. Tobin, Richland, Wash.

[73] Assignee: The United States of America as represented by the United States Department of Energy, Washington, D.C.

[21] Appl. No.: 55,210

[22] Filed: Jul. 5, 1979

[51] Int. Cl.[3] ..... C21D 1/00

[52] U.S. Cl. ..... 148/136; 148/38

[58] Field of Search ..... 148/3, 12 F, 37, 38, 148/135, 136

[56] References Cited

U.S. PATENT DOCUMENTS

| | | | |
|---|---|---|---|
| 2,486,283 | 10/1949 | Hoffman | 148/135 |
| 2,686,116 | 8/1954 | Schempp | 148/136 |
| 2,873,187 | 2/1959 | Dyrkacz et al. | 148/38 |
| 3,776,720 | 12/1973 | Dudek | 148/136 |
| 3,944,442 | 3/1976 | Donachie | 148/12 F |
| 4,127,428 | 11/1978 | Izumiyama et al. | 148/38 |

*Primary Examiner*—Peter K. Skiff

*Attorney, Agent, or Firm*—Robert Southworth, III; Richard E. Constant; James E. Denny

[57] ABSTRACT

Duplex stainless steel materials containing austenite plus delta ferrite, are dimensionally stabilized by heating the material to a reaction temperature between about 1050°-1450° F. (566°-788° C.), holding it at this temperature during transformation of delta ferrite to austenite plus sigma phase, and subsequently heating to a reversion temperature between about 1625°-1750° F. (885°-954° C.), whereby the sigma phase transforms back to ferrite, but the austenite remains dispersed in the ferrite phase. Final controlled cooling permits transformation of ferrite to austenite plus sigma and, later, precipitation of carbides.

4 Claims, 7 Drawing Figures

PROCESS FOR STABILIZING DIMENSIONS OF DUPLEX STAINLESS STEELS FOR SERVICE AT ELEVATED TEMPERATURES

BACKGROUND OF THE INVENTION

This invention pertains to austenitic stainless steels that contain a significant portion of delta ferrite, that will be exposed to elevated temperatures in service and that will be used in machine or equipment parts or members requiring stable dimensions. In this disclosure, the term "duplex" is used to describe stainless steels containing a dual microstructure of austenite plus delta ferrite. Specifically, the invention consists of a unique heat treating process by which the dimensions of such duplex stainless steels can be stabilized for service at elevated temperatures.

Ferrite-containing austenitic stainless steel castings are frequently specified for machine and structural elements because of their many desirable characteristics, such as:

(a) High yield strength
(b) Good resistance to hot tearing on casting
(c) Good resistance to hot cracking during welding
(d) Good resistance to stress-corrosion cracking.

They have one disadvantage—their metallurgical instability at elevated temperatures.

The invention is applicable to austenitic stainless wrought alloys, weld deposits or castings, as long as they contain delta ferrite. However, the invention is particularly useful in the treatment of castings because we have found that the high level of delta ferrite typically present in many commercial grades of stainless castings, for example 8 to 18%, can lead to large dimensional changes during exposure to elevated temperatures. As will later be described, a major portion of the shrinkage is caused by transformation of delta ferrite ($\delta$) to austenite ($\gamma$) plus the brittle sigma phase ($\sigma$).

It is, therefore, an object of this invention to treat materials so as to stabilize their dimensions against further change during long service exposure to elevated temperature, without seriously impairing the ductility of the material through precipitation of large brittle particles.

It is also an object of this invention to provide for relief of residual stress during the course of the dimensional stabilization treatment and to accomplish both of these objectives in a reasonable and economic time period. Since the process to be described involves slow cooling through the carbide precipitation temperature range, the invention is preferably practiced on members that will not be exposed to corrosive environments. Alloys treated according to our invention perform satisfactorily in liquid sodium.

DESCRIPTION OF A PREFERRED EMBODIMENT

The practice of the invention can be described in terms of a specific application, such as a CF8 stainless steel bearing support for a liquid sodium pump. However, the following example is to be understood to be by way of illustration only and does not preclude application of the invention to other cast stainless alloys, such as, but not restricted to CF8A, CF8C and CF8M; weld deposits, such as Type 307, 308, 309, 316, 347 and 16-8-2; or wrought products with a mixed austenite plus delta ferrite microstructure, wherein delta ferrite is present in amounts exceeding about 6%. The process may also be used for other types of machine structures, as would be apparent to others well versed in the art. The invention is only limited by the scope of the appended claims.

A large liquid sodium pump for the Fast Flux Test Facility failed during its qualification tests. This prototype pump had operated on test for only 4000 hours at 400° to 1050° F. (204°-566° C.), of which approximately 400 hours was at 1050° F. (566° C.), until a bearing failure occurred during the intentional application of a thermal transient. When the pump was disassembled, it was found that shrinkage of the cast CF8 stainless steel bearing support had squeezed the bearing, reducing the clearance between the bearing and the shaft to the point that the thermal transient induced a bearing failure.

Figure 4:
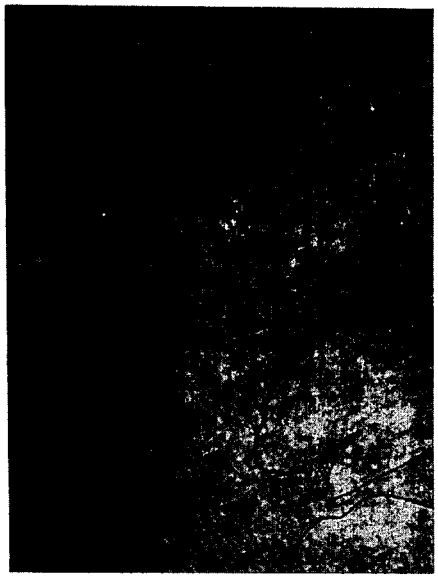
FIG. 4 is a photomicrograph of the delta ferrite and austenite in a solution treated CF8 stainless steel casting.

The bearing support had been fabricated from two large CF8 stainless steel castings by welding. Welded sections were about 4 inches thick. The bolt flange was 6 feet in diameter and 8.5 inches thick. The individual castings had been solution treated 4 hours at 2000° F. (1093° C.) and quenched prior to welding, producing the duplex microstructure of delta ferrite in austenite illustrated in FIG. 4. No stress relief treatment had been applied after welding. An investigation was undertaken to identify the cause or causes of the shrinkage, using both production housings and test material obtained from the flanges by core drilling.

Figure 1:
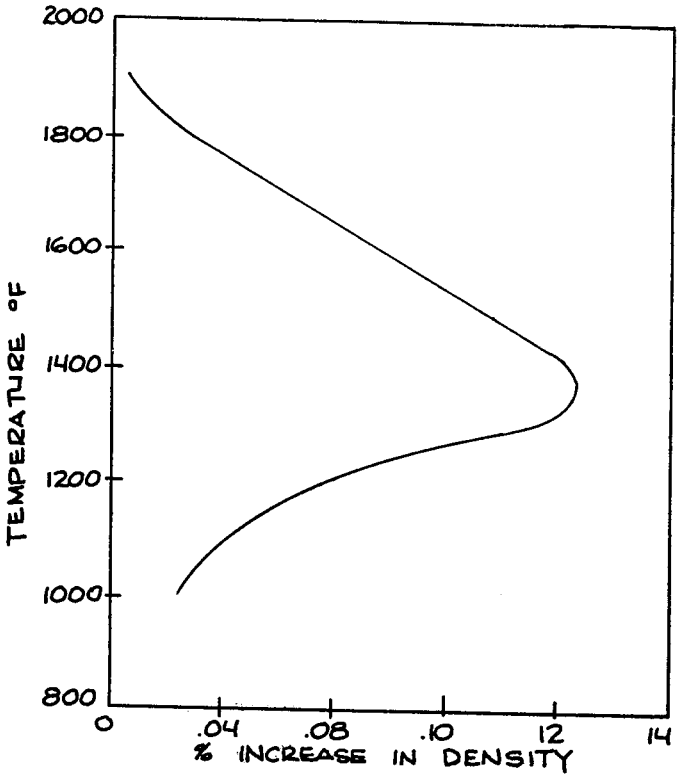
FIG. 1 is a plot of aging temperature versus % increase in density for a solution treated CF8 stainless steel casting.
Figure 5:
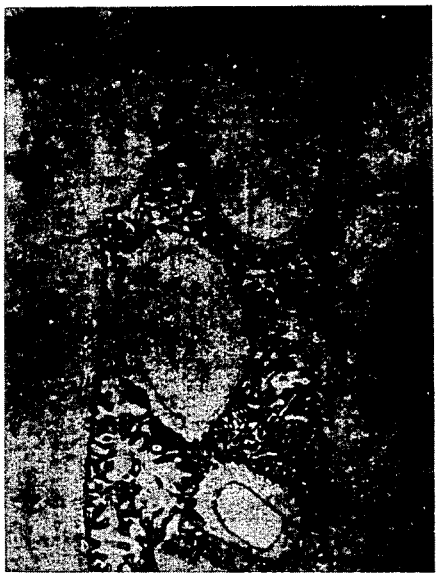
FIG. 5 is a photomicrograph illustrating transformation of $\delta \rightarrow \gamma + \sigma$ in a CF8 stainless steel casting during "reaction" of 50 hours at 1375° F. (746° C.)

When it was learned that only about 60% of the observed shrinkage of the prototype bearing support could be accounted for by relaxation of residual stresses in service, a study was made to determine whether metallurgical reactions, such as carbide precipitation or ferrite transformation could have contributed to the change in dimension. FIG. 1 shows the effects on density of specimens aged 20 hours at temperatures from 1050° to 1650° F. (566° to 899° C.). For the given aging time, there was a pronounced maximum in % density change at about 1375° F. (746° C.), where the increase was 0.17% for this particular casting. This far exceeded the density increase of 0.06% reported in the literature for fully austenitic wrought Type 304 stainless steel aged 2000 hours at 1336° F. (725° C). Metallography and magnetic (Magnegage) measurements revealed that the initial delta ferrite in this casting of 14.8% dropped to 7.7% as the ferrite transformed to austenite plus sigma, as illustrated in FIG. 5. With additional aging of 168 hours at 1125° F. (607° C.) and 1100 hours at 1050° F. (566° C.), the final density increase was 0.23%. Since the ferrite content was essentially unchanged by those two lower temperature ages, the later part of the density increase was probably by carbide precipitation.

Since the linear dimension changes are one third of the density change and of opposite sign, a 0.23% density corresponds to a linear shrinkage of 0.0775%. On the 15 inch (371 mm) diameter opening in the bearing support, this amounts to 0.012 inch (0.305 mm). This is about one half the clearance between the bearing and the shaft in the sodium lubricated bearing.

It was thus clear that solution treated CF8 castings were dimensionally unstable at temperatures in the range of 1050° to 1650° F. (566° to 899° C.). Although the tests were not of sufficient duration to determine the total extent of the volume change that could occur, the dimensional shrinkages, even in those brief exposures, were of sufficient magnitude to lend credence to the postulate that shrinkage of the bearing support from metallurgical reactions, in addition to stress-relief, exceeded the bearing tolerance and caused a seizure.

A theoretical explanation can be found for the marked difference in shrinkage behavior of fully austenitic steels and duplex steels. From tie-line data in the Fe-Cr-Ni ternary phase diagram, it is found that at the solution treatment temperature, the austenite of a typical CF8 steel has a composition of about 19% Cr and 9.5% Ni, whereas the delta ferrite has a composition of about 33% Cr and 2.7% Ni. At typical service temperatures for many stainless steel castings, 900°-1200° F. (482°-649° C.), the delta ferrite composition falls within a three-phase field, ferrite plus austenite plus sigma, of the ternary diagram. This explains why ferrite can transform to austenite plus sigma.

We have observed that the rate and extent of formation of sigma in CF8 castings is very much greater than in fully austenitic wrought Type 304 stainless steel. This behavior results from a combination of factors, all of which are related to the presence of delta ferrite in CF8 castings. In the first place, the ferrite/austenite interphase interface provides a large area for nucleation. Secondly, since ferrite contains high Cr and low Ni, it is considerably closer to the sigma composition than is austenite. A much smaller composition fluctuation is therefore needed to produce a stable sigma nucleus in ferrite than in austenite. Finally, as the growing sigma requires Cr and rejects Ni, the adjoining ferrite transforms to austenite. The result is a lamellar structure, sometimes spheroidized, which grows into the ferrite by a cellular precipitation mechanism, and in which the diffusion distances are only the interlammellar spacing. Moreover, much of the transport of Cr and Ni occurs by the rapid mechanism of interphase boundary diffusion. It is therefore not surprising that the rate of formation of sigma in a casting containing delta ferrite can be orders of magnitude faster than in a fully austenitic stainless steel. This rapid transformation of ferrite accounts for the larger and more rapid increase in density in CF8 castings than in Type 304. The contribution to the increase in density from the precipitation of carbides would be comparable in the two materials.

The reversed "C" shaped reaction curve (FIG. 1) can also be explained in a qualitative way. The driving force for the transformation of $\delta \rightarrow \gamma + \sigma$ increases as the temperature drops from some temperature where the supersaturation is zero. On the other hand, atomic mobility (diffusion) decreases exponentially as temperature falls. The product of these two factors is a measure of the reaction rate. For the steel illustrated in FIG. 1, the maximum rate of transformation, as measured by density increase, was at about 1375° F. (746° C.).

Although the 1375° F. (746° C.) age produced the most rapid change in density, coarse sigma particles were formed that decreased tensile ductility. Tensile tests were run on several CF8 castings produced by the same commercial foundry. The castings included several bearing support brackets, keel blocks and a large valve body.

Some test specimens demonstrated severe loss in room temperature tensile ductility from aging 50 hours at 1375° F. (746° C.). For tensile tests at 1000° F. (538° C.), the effect of aging is still present, although it is not quite as severe. Moreover, after 50 hours at 1375° F. (746° C.), additional densification can occur during the lower temperature exposure in service, for example, at 1050° F. (566° C.). There is, therefore, a clear need for a heat treatment that would accomplish more complete densification and with less harmful effect on the ductility.

Figure 6:
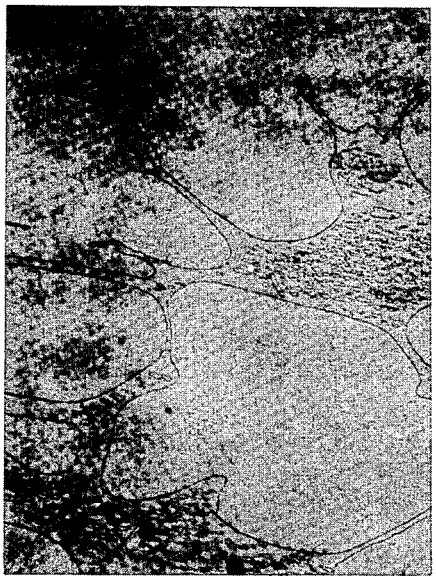
FIG. 6 is a photomicrograph of a CF8 stainless steel casting after "reaction" for 50 hours at 1375° F. (746° C.) and "reversion" for 2 hours at 1750° F. (954° C.) to transform the sigma back to ferrite.
Figure 7:
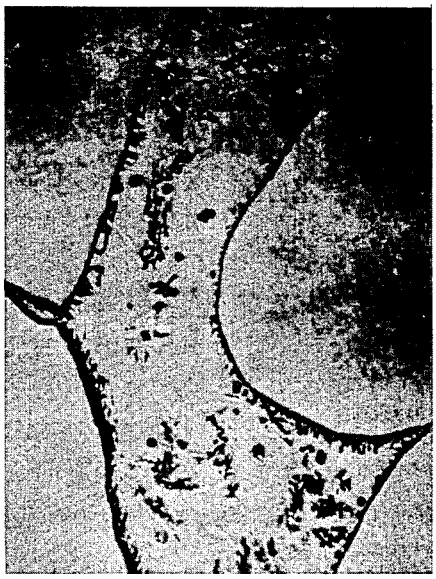
FIG. 7 is a photomicrograph illustrating the final microstructure resulting from dimensional stabilization of a CF8 stainless steel casting, as practiced according to our invention.

We have discovered a unique heat treating cycle that fulfills these objectives. In general terms, the invention, which applies only to stainless steels containing appreciable quantities of delta ferrite, consists of heating the mechanical element to a "reaction" temperature at which delta ferrite partially transforms to austenite plus sigma phase and holding for a period of time; further heating to a "reversion" temperature at which sigma transforms back to ferrite but at which the previously transformed austenite remains dispersed within the ferrite phase (FIG. 6); and finally controlled continuous cooling to permit transformation, initially, of ferrite to austenite plus sigma in a finer dispersion than in the "reaction" step and eventually, at lower temperatures, precipitation of carbides (FIG. 7). We have found that such a cycle produces essentially complete densification with a minimum effect on tensile ductility. These heat treating steps are also consistent with removal of the original residual stresses from casting, quenching, forming, machining, or welding, and obtaining a treated part in which residual stresses have not been reintroduced by plastic distortion during cooling.

We believe that the outstanding results achieved by the heat treatment are related to the "reaction"—"reversion" steps producing a dispersion of austenite particles within the ferrite, which accomplishes part of the densification, and which provides a much larger ferrite/austenite interface for transformation on subsequent cooling. The rate of transformation of ferrite to austenite plus sigma on cooling is thus enhanced, and the cooling rate can be moderately rapid so that transformation is at a fairly low temperature, where the sigma particles are small, so that their effect on ductility is minimized.

More specifically, our invention consists of heating the duplex stainless steel member to a "reaction" temperature between about 1050° F. (566° C.) and about 1450° F. (788° C.). The holding time at the optimum temperature of about 1375° F. (746° C.), where the reaction rate of $\delta \rightarrow \gamma + \sigma$ is greatest (see FIG. 1), is from about 10 to 80 hours. Longer holding at this temperature is permissible, but the benefits do not justify, the additional cost. Higher or lower temperatures would require longer times, for example, 400 hours at 1050° F. (566° C.), which, although possible technically, is not economically attractive. Reaction at temperatures in the top of the range has the disadvantage of producing coarser sigma and austenite particles.

The member is then heated to a "reversion" temperature of about 1625°-1750° F. (885°-954° C.) to convert the sigma phase back to ferrite. At temperatures of about 1625°-1650° F. (885°-899° C.), in some heats of steel, the sigma is not completely eliminated. At temperatures much above 1750° F. (954° C.), the austenite within the ferrite could dissolve and the original solution-treated structure would be obtained. The part would then return to its original volume, and the extra interfacial area, which is desired, would be lost. The preferred reversion temperature range is therefore about 1675°-1700° F. (913°-927° C.). The holding time at this temperature is not critical. Sigma transforms to ferrite very quickly, because there is only a phase transformation involved, with no change in composition. However, to insure a uniform temperature throughout the member, holding should be approximately ½ to 2 hour per inch (25.4 mm) of maximum section thickness.

Finally the member is cooled at a rate of between about 10 and 200° F./hour (6 and 110° C./hr). Slower rates would permit high temperature formation of coarse sigma particles and detract from tensile ductility. Furnace times for heat treatment would also become excessive. Faster rates would leave the densification process incomplete and could lead to reintroduction of residual stresses because of thermal gradients in the part. Controlled cooling is continued through the temperature range 1300°-1000° F. (704°-538° C.) and to below about 800° F. (427° C.) to permit precipitation of carbides, because this reaction also contributes to the densification process. The part is thereby stabilized against dimensional changes during service at temperatures up to about 1200° F. (649° C.).

Application of the Invention

Figure 2:
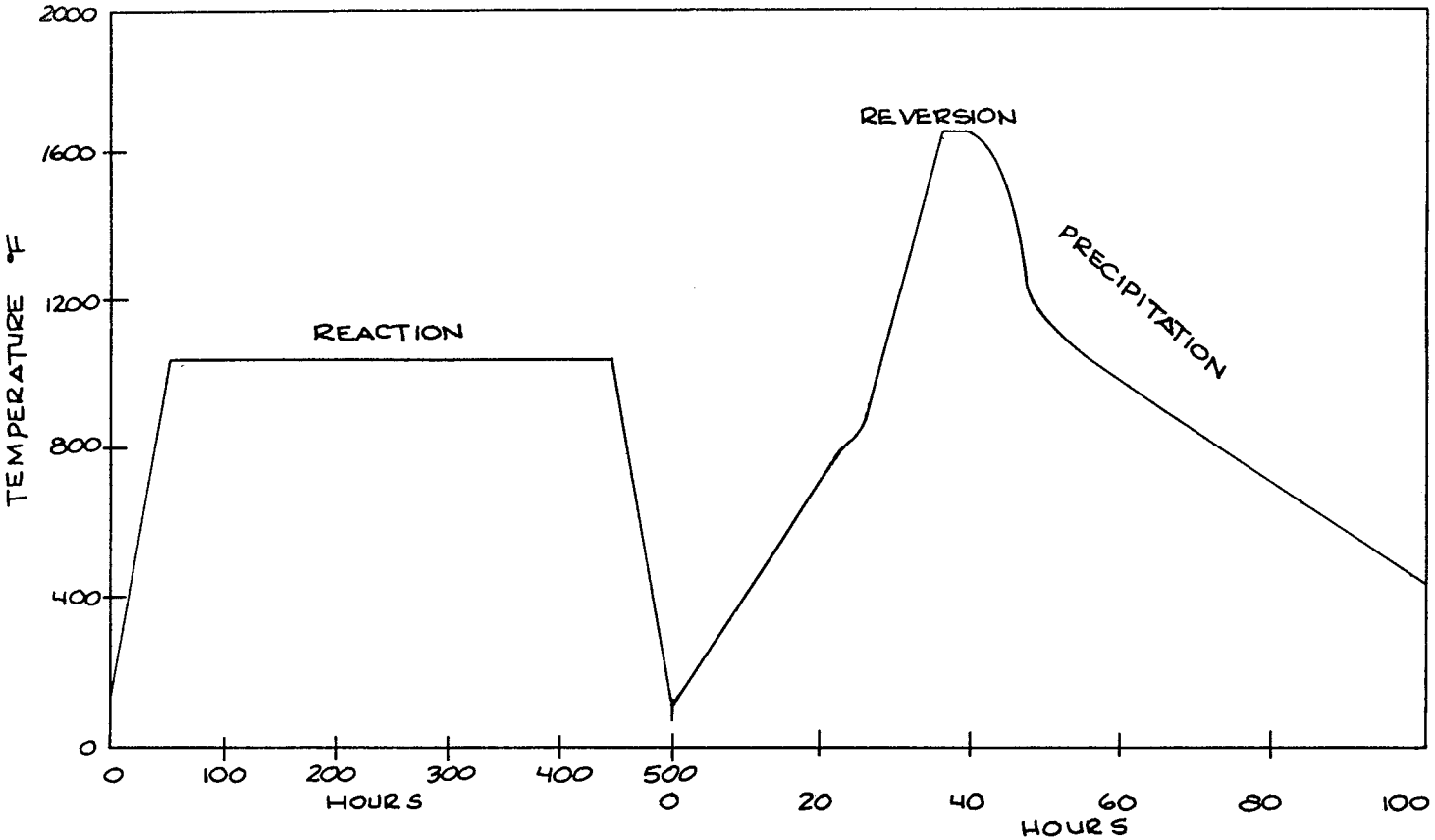
FIG. 2 is a plot of temperature versus time used in the dimensional stabilization of the prototype pump CF8 stainless steel bearing support.

The aforementioned CF8 bearing support for the prototype liquid sodium pump had, in service, been subjected to the equivalent of the "reaction" temperature holding of 400 hours at 1050° F. (563° C.). In order to complete the stabilization treatment, the support was therefore simply heated to the "reversion" temperature of 1650° F. (899° C.) for 4 hours and slowly cooled. FIG. 2 is a plot of temperature versus time showing the thermal history of the part. Densification, which had caused the bearing failure, continued during the above treatment. The critical dimensions of the support were then remachined, and it was reinstalled in the pump. The pump was then subjected to operational testing for an additional 2800 hours, 400 hours of which was above 1000° F. (538° C.). The pump satisfactorily sustained even more severe thermal transients than in the original test; and subsequent examination of the disassembled bearing support confirmed that the dimensions had indeed been stabilized, and no change had occurred during the final qualification testing.

Figure 3:
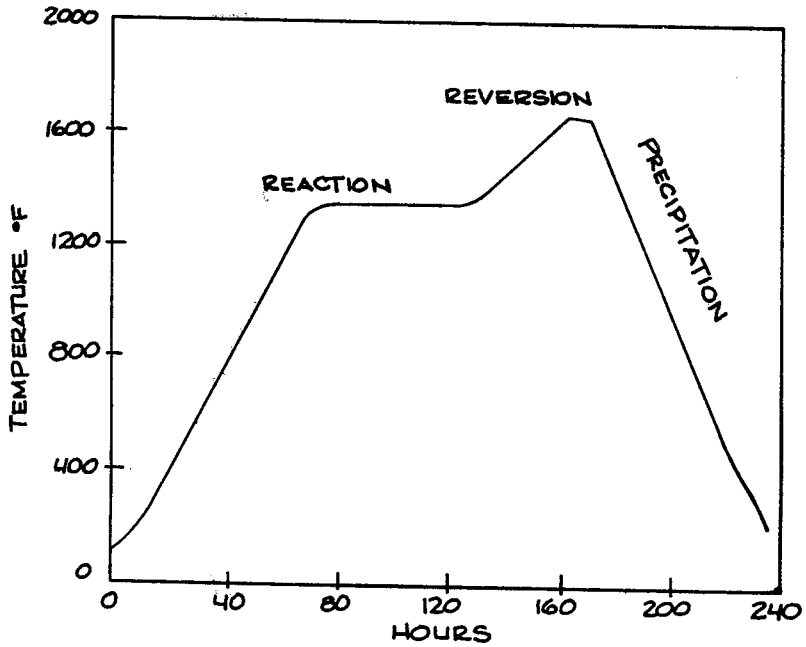
FIG. 3 is a plot of temperature versus time for dimensional stabilization by our preferred process.

It will be apparent to one versed in the art, that, after the "reaction" treatment, the part could be cooled down and then reheated for the "reversion" treatment. This, in fact, represents the history of the prototype pump bearing support. However, it is obvious that it is saving in time, expense and energy if the heating to the "reversion" temperature follows immediately after the "reaction" treatment. FIG. 3 shows a typical plot of time and temperature for a part processed according to the preferred application of this disclosure.

Having described our invention, we claim:

1. A process for stabilizing the dimensions of a member made of duplex stainless steel having a dual microstructure of austenite plus delta ferrite and which is to be exposed in service to temperatures in the range of 900°-1200° F. (489°-788° C.) said process comprising the following steps:

heating the member to a reaction temperature about 1375° F. (746° C.);

maintaining the member at a temperature of about 1375° F. (746° C.) for about 50 hours;

subsequently raising the temperature of the member to a reversion temperature in the range of about 1625°-1750° F. (885°-954° C.);

maintaining the member at a temperature within the reversion temperature range for a period of about ½ to 2 hours per inch (25.4 mm) of maximum section thickness in the member;

and subsequently cooling the member from the reversion temperature to at least 800° F. (427° C.) at a rate between about 10° and 200° F. (6° and 110° C.) per hour.

2. A process as set out in claim 1 wherein the step of heating the member to a reaction temperature is accomplished by heating the member to about 1375° F. (746° C.);

the member is maintained at a temperature of about 1375° F. (746° C.) for about 50 hours; and the step of heating the member to a reversion temperature is accomplished by heating the member to about 1675° F. (913° C.).

3. A process as set out in claim 1 wherein the step of heating the member to a reaction temperature is accomplished by heating the member to about 1375° F. (746° C.);

the member is maintained at a temperature of about 1375° F. (746° C.) for about 50 hours;

the step of heating the member to a reversion temperature is accomplished by heating the member to about 1675° F. (193° C.); and the member is maintained at a temperature of about 1675° F. (193° C.) for about ½ to 2 hours per inch (25.4 mm) of maximum section thickness.

4. A process as set out in claim 1 wherein the step of heating the member to a reaction temperature is accomplished by heating the member to about 1375° F. (746° C.);

the member is maintained at a temperature of about 1375° F. (746° C.) for about 50 hours;

the step of heating the member to a reversion temperature is accomplished by heating the member to about 1675° F. (913° C.);

the member is maintained at a temperature of 1675° F. (913° C.) for about ½ to 2 hours per inch (25.4 mm) of maximum section thickness; and the member is subsequently cooled at a rate of approximately 25° F. (14° C.) per hour to a temperature below about 1000° F. (538° C.).

* * * * *